US009109267B2

(12) United States Patent
Amirzadeh-Asl et al.

(10) Patent No.: US 9,109,267 B2
(45) Date of Patent: Aug. 18, 2015

(54) PROCESS FOR THE INTRODUCTION OF INORGANIC SOLIDS INTO HOT LIQUID MELTS

(75) Inventors: Djamschid Amirzadeh-Asl, Moers (DE); Dieter Fünders, Dulsburg (DE)

(73) Assignee: Sachtleben Chemie GmbH, Duisburg (DE)

( * ) Notice: Subject to any disclaimer, the term of this patent is extended or adjusted under 35 U.S.C. 154(b) by 0 days.

(21) Appl. No.: 13/173,565

(22) Filed: Jun. 30, 2011

(65) Prior Publication Data

US 2011/0265607 A1 Nov. 3, 2011

Related U.S. Application Data

(63) Continuation of application No. 10/578,180, filed as application No. PCT/EP2004/012507 on Nov. 5, 2004, now abandoned.

(30) Foreign Application Priority Data

Nov. 6, 2003 (DE) ..... 103 51 686

(51) Int. Cl.

| | |
|---|---|
| ***C22B 9/10*** | (2006.01) |
| ***C21B 5/02*** | (2006.01) |
| ***C21C 7/00*** | (2006.01) |

(52) U.S. Cl.
CPC ..... *C21B 5/026* (2013.01); *C21C 7/0037* (2013.01)

(58) Field of Classification Search
None
See application file for complete search history.

(56) References Cited

U.S. PATENT DOCUMENTS

| | | | | |
|---|---|---|---|---|
| 3,898,076 | A | 8/1975 | Ranke | |
| 4,260,417 | A * | 4/1981 | Bartos | 75/10.15 |
| 4,362,559 | A | 12/1982 | Perez et al. | |
| 4,398,946 | A * | 8/1983 | Doliwa | 420/33 |
| 5,021,086 | A * | 6/1991 | Luydkx et al. | 75/315 |
| 5,554,207 | A | 9/1996 | Bogdan et al. | |
| 5,972,072 | A * | 10/1999 | Kinsman et al. | 75/315 |
| 6,372,013 | B1 * | 4/2002 | Trout et al. | 75/309 |
| 2003/0177864 | A1 * | 9/2003 | Nakai et al. | 75/313 |

FOREIGN PATENT DOCUMENTS

DE 101 32 843 A 1/2003

* cited by examiner

*Primary Examiner* — Melvin C Mayes
*Assistant Examiner* — Stefanie Cohen
(74) *Attorney, Agent, or Firm* — Norton Rose Fulbright US LLP

(57) ABSTRACT

A method for the introduction of inorganic solid bodies into hot, liquid melts, whereby inorganic solid bodies are added to a plastic containing hydrocarbon and the mixture obtained is added to the hot, liquid melt.

21 Claims, No Drawings

PROCESS FOR THE INTRODUCTION OF INORGANIC SOLIDS INTO HOT LIQUID MELTS

This application is a continuation application of U.S. Ser. No. 10/578,180 filed Sep. 28, 2006, now abandoned, incorporated herein by reference in its entirety, which is a §371 of PCT/EP2004/012507 filed Nov. 5, 2004, which claims priority from German Patent Application No. 103 51 686.7 filed Nov. 6, 2003.

The invention relates to a process for the introduction of inorganic solids into hot liquid melts.

Hot liquid melts are understood here as meaning metallurgical melts and/or slags found erg, in a furnace.

In metallurgy, fluxes often have to be added to the hot liquid metals or slags in the various processing stages. This applies to both the iron and steel industry and non-ferrous metallurgy. Fluxes are used e.g. in the following metallurgical processes:

Primary metallurgy: products for liquefying the slag-forming additives during the smelting phase, and fluxes for the blast furnace industry for the purpose of prolonging the durability of the refractory lining of the blast furnace hearth.

Secondary metallurgy: fluxes for the top slags of melts for the purpose of adjusting the metallurgical properties of the melts to the desired values. It is possible here to use fluxes which have a direct chemical influence on the properties of both the liquid metals and the liquid slags, as well as fluxes which have a physical influence on the consistency of the particular reactants. Normally, in the case of a physical influence, a depression of the melting point of the slags is sought in order to influence the metallurgical reaction kinetics of the systems with the aim of enabling the reaction in the first place and furthermore accelerating it.

Tertiary metallurgy: In this final phase of the metallurgical production stages, at the last possible point immediately upstream of the pouring process, an attempt is made both chemically to adjust the properties of the end products, by adding metallurgically effective substances, and physically to influence the solidification structure of the particular metals to be poured, by adding exogenous nuclei.

To be able to introduce the fluxes into the hot liquid melts (metals or slags) in the respective processing stages, the following known technologies, inter alia, are used:

Addition of the normal, coarse fluxes from a variety of usually fully automatic weighing and bunker systems via simple gravity conveyors and hopper systems.

Addition of the fluxes in sack-like forms of packaging, e.g. sacks or big bags, either by hand or by means of cranes.

Addition of the fluxes by means of filler wires, the cavities of the filler wires (often consisting of a metallic alloying agent) containing the particular flux(es).

Addition of the fluxes by means of injection equipment, which generally consists of a weighing and bunker system with a downstream gas overpressure injection system. Gas overpressure systems are mechanically adapted to the particular requirements of the intended applications (e.g. high-pressure or low-pressure plant. The carrier gases used can be compressed air, nitrogen or other gases, as required. If fluxes are to be injected into the furnace (e.g. blast furnace) without direct liquid contact, the solid flux can be introduced into the furnace chamber against the furnace pressure via a fixed injection lance. If solid fluxes are to be injected into the furnace (e.g. electric furnace) in the boundary layer between liquid iron and liquid slag, for the purpose of foaming the slag, the injection pressure has to be adapted to the physical proportions of the metallurgical system. Also, the injection lance must remain movable in this case in order to be able to adapt flexibly to the respective phases of the scrap smelting process.

A common feature of all the systems is that the physical consistency of the fluxes exerts a decisive influence on the technology of addition. Because of their intrinsic weight, coarse products fall without difficulty through the rising process gases into the smelting area. On the other hand, products of medium particle size are sucked up by the buoyancy forces of the process gases or the suction forces of the filter plants before they can develop their desired action in the liquid media. For this reason they are first packed in sacks or big bags and then introduced into the system all at once. Even if they are first packed in big bags or sacks, fine fluxes still cannot be protected from being drawn away from the liquid media by the ascending convection current or suction forces after the sacks have burnt off, and from accumulating in undesirable manner in the filter plants.

The object of the invention is to overcome the disadvantages of the state of the art and provide a novel process by which fine inorganic fluxes, in particular, can be introduced into metallurgical smelting systems.

The object is achieved by a process for the introduction of inorganic solids (=fluxes) into hot liquid melts wherein inorganic solids are added to a hydrocarbon-containing plastic and the resulting mixture is introduced into the hot. liquid melts.

The inorganic solids are preferably added in the form of fine particles. 90% of the inorganic solid particles have sizes particularly preferably of 0.01 μm to 5 mm and very particularly preferably of 0.1 μm to 2 mm.

The proportion of inorganic solids in the plastic is preferably 0.5 to 90 wt. %, particularly preferably 2 to 70 wt. % and very particularly preferably 5 to 50 wt. %, based in each case on the mixture.

The inorganic solids (=fluxes) used are preferably titanium-containing substances and/or substances containing iron oxide, aluminium oxide, magnesium oxide, calcium oxide, silicates or slag-forming additives, individually or as a mixture. In particular, the substances containing iron oxide, aluminium oxide, magnesium oxide, calcium oxide, silicates or slag-forming additives can be industrial residues. Very particularly preferably, the flux contains synthetic titanium dioxide.

Apart from hydrocarbons, the plastic preferably also contains the element nitrogen. For economic reasons the plastic used is preferably old plastic.

The mixture of plastic and flux can be prepared in a variety of ways:

The plastic is mixed in solid form (preferably as granules, matrix agglomerate or pot agglomerate) with the inorganic solids. The inorganic solids are preferably added to the plastic during the production of the plastic granules. The flux adheres to the plastic surface in the mixture obtained. This mixture is introduced into the hot liquid substances (metallurgical melts and slags).

The plastic is mixed in liquid (molten) form with the inorganic solids. The mixture of molten plastic and inorganic solids (=fluxes) is preferably cooled so that it solidifies. The plastic/flux mixture can then be ground, or shredded.

When the plastic/flux mixture is in the appropriate form (e.g. as powder or granules), the mixture can preferably be introduced into the hot liquid melts by injection. The plastic/flux mixture can also be used in the form of lumps. For this purpose shaped bodies of the particular desired dimensions can be produced from the mixture by pressing.

One advantage of the process according to the invention is that, by being introduced, in a mixture with the plastic, the flux can be proportioned very well and introduced into the hot liquid melts in divided form. This applies especially to fluxes in the form of dust. Industrial residues in the form of dust, containing iron oxide, aluminium oxide, magnesium oxide, calcium oxide, silicates or slag-forming additives, can thus be utilized industrially. These residues are preferably mixed with synthetic titanium dioxide and then, as described, with the plastic.

Another advantage of the process according to the invention is that the plastic not only serves as a vehicle for the flux, but can also act as a reducing agent and/or energy carrier (partially replacing heavy oil or coal). In the case where the flux contains titanium, especially synthetic titanium compounds, the plastic contributes in the hot liquid melt to the desired formation of titanium carbides and, if the element nitrogen is present, titanium nitrides and titanium carbonitrides. These compounds improve the refractory properties of the furnace wall in e.g. furnace systems.

The invention claimed is:

1. A process for improving the refractory properties of a furnace wall comprising the steps of:

adding inorganic solid particles to a hydrocarbon-containing plastic that has a surface to form a mixture, wherein the inorganic solid particles adhere to the surface of said hydrocarbon-containing plastic and wherein the inorganic solid particles comprise a titanium-containing substance; and introducing the mixture into a hot liquid melt in a furnace comprising the furnace wall, wherein 90% of the inorganic solid particles have a particle size in the range of from 0.01 μm to 5 mm, wherein the proportion of inorganic solid particles in the mixture of particles and plastic is 0.5 to 90 wt. %.

2. A process according to claim 1, wherein 90% of the inorganic solid particles have particle sizes of from 0.1 μm to 2 mm.

3. A process according to claim 1, wherein the proportion of inorganic solid particles in the mixture of particles and plastic is from 2 to 70 wt. %.

4. A process according to claim 1, wherein the inorganic solid particles further comprise at least one solid selected from the group consisting of iron oxide, aluminum oxide, magnesium oxide, calcium oxide, a silicate, and a slag forming additive.

5. A process according to claim 4, wherein the titanium containing substance is titanium dioxide.

6. A process according to claim 4, wherein the plastic contains nitrogen.

7. A process according to claim 6, wherein the titanium dioxide reacts with said nitrogen to form a titanium nitride when introduced into the hot liquid melt.

8. A process according to claim 5, wherein the titanium dioxide is synthetic.

9. A process according to claim 1, wherein the plastic comprises nitrogen.

10. A process according to claim 1, wherein the plastic used is recycled plastic.

11. A process according to claim 1, wherein the plastic is mixed in solid form with the inorganic solid particles.

12. A process according to claim 1, wherein the mixture is introduced into the liquid melt by injection.

13. A process according to claim 1, wherein the mixture is introduced into the liquid melt in the form of lumps.

14. A process according to claim 1, wherein the plastic is mixed in solid form with the inorganic solid particles and the inorganic particles adhere to a surface of the plastic.

15. The process according to claim 1, wherein the titanium-containing substance is synthetic.

16. A process comprising mixing a solid plastic that has a surface with inorganic solid particles so that the inorganic solid particles adhere to the surface of the solid plastic to form a mixture, and adding the mixture to a liquid melt.

17. A process according to claim 16, wherein the plastic is in the form of a granule, matrix agglomerate or pot agglomerate.

18. A process according to claim 16, wherein the plastic is in the form of a plastic granule and the inorganic solid particles are added to the plastic during formation of said granules.

19. A process comprising:

mixing particulate synthetic titanium dioxide with inorganic solid particles selected from the group consisting of iron oxide, aluminum oxide, magnesium oxide, calcium oxide, a silicate, and a slag forming additive to form a particulate inorganic mixture comprising inorganic particulates; and mixing the particulate inorganic mixture with solid plastic granules which have a surface such that the inorganic particulates of the particulate inorganic mixture adhere onto the surface of the solid plastic granules to form a granulate plastic flux mixture, wherein 90% of the inorganic solid particles have a particle size in the range of from 0.01 μm to 5 mm.

20. A process according to claim 19, wherein the granulate plastic flux mixture is ground or shredded.

21. A process according to claim 19, wherein the granulate plastic flux mixture is added to a hot liquid melt that comprises plastic.

* * * * *